US007686307B1

(12) United States Patent
Moss

(10) Patent No.: US 7,686,307 B1
(45) Date of Patent: Mar. 30, 2010

(54) MULTISTAGE WAGERING CARD GAME AND METHOD THEREFOR

(76) Inventor: David Moss, 7777 E. Main St., #264, Scottsdale, AZ (US) 85251

( * ) Notice: Subject to any disclaimer, the term of this patent is extended or adjusted under 35 U.S.C. 154(b) by 61 days.

(21) Appl. No.: 12/210,320

(22) Filed: Sep. 15, 2008

(51) Int. Cl.
*A63F 1/00* (2006.01)

(52) U.S. Cl. ..... 273/292; 273/274; 463/12

(58) Field of Classification Search ..... 273/292, 273/274, 309; 463/12
See application file for complete search history.

(56) References Cited

U.S. PATENT DOCUMENTS 5,275,415 A * 1/1994 Wisted ..... 273/274
5,645,281 A * 7/1997 Hesse et al. ..... 273/292
6,406,020 B1 * 6/2002 Reed ..... 273/274
6,776,416 B1 * 8/2004 Jackson ..... 273/292
6,855,051 B1 * 2/2005 Mostashari ..... 463/12

* cited by examiner

*Primary Examiner*—Benjamin H Layno
(74) *Attorney, Agent, or Firm*—Craig Weiss; Weiss & Moy, P.C.

(57) ABSTRACT

A blackjack-type card game with multistage wagering that provides a predetermined set of rules for when a player receives two or three cards, thus removing the option of splitting, doubling-down, or purchasing insurance. The game comprises areas for a player to place an first wager and a second wager. A transitional area is used to transfer the first wager to in given circumstances. The invention may or may not also include an area for an optional bonus wager, wherein the bonus wager would be either collected or paid according to a preset payout schedule and depending upon the cards of the player placing the bonus wager.

10 Claims, 2 Drawing Sheets

MULTISTAGE WAGERING CARD GAME AND METHOD THEREFOR

FIELD OF THE INVENTION

The present invention relates generally to card games and methods therefor and, more particularly, to a blackjack-type card game with multistage wagering and an optional bonus wagering area where a player receives either two or three cards based upon preset rules, which are independent of a player's decision-making, and where a player is paid according to a predetermined wagering structure dependent upon a player's wager-making decisions.

BACKGROUND OF THE INVENTION

Various casino games have been invented and implemented across the United States and the world, and with an increasing occurrence in recent history. This is due to a desire by gambling establishments to invent newer, faster, and more attractive table games in order to achieve untapped revenue streams. However, for these newly invented table games to be a successful source of revenue for the gambling industry, the games must draw a critical amount of players. It appears that in order to accomplish this task soon after the game's introduction to the public, it is necessary to give these newly invented games some degree of familiarity by including some aspect of a previously popular game, so as to attract players already familiar with certain aspects of the game common with more established games.

Additionally, wildly popular and well-established games have failed to attract other potential players due to their complexity or intimidating nature, thereby scaring off these potential players as well as the additional revenue that they represent. Further still, well-established games, such as blackjack, give their players a wide range of options for continuing play following the initial wager (doubling down, splitting, hitting, standing, etc.). This, combined with the potential for making a strategically disadvantageous decision, or inappropriately "taking" another player's card, may cause certain players to be intimidated to the point of completely avoiding the game.

The present invention solves the aforementioned problems by incorporating elements of a familiar game, thereby attracting veteran gamblers to a new game, while at the same time limiting the decision-making of the players to only "when to bet" and "how much to bet," thereby making the present invention more attractive to the inexperienced player by removing the fear of making the "wrong" decision to hit or stand, which could negatively affect the hands of the remaining players at the table.

SUMMARY OF THE INVENTION

It is an object of the present invention to provide a multistage wagering card game that provides each player with two or three cards based upon preset rules which are independent of a player's decision-making and which pays a player according to a predetermined wagering structure dependent upon each player's wager-making decisions.

It is a further object of the present invention to provide a multistage wagering card game that provides a transitional area where a player's first wager can be placed if the player's initial hand is weaker than the dealer's initial hand, giving such a player a chance of getting the first wager back from the transitional area should the player not fold his initial hand and should the player's final hand be a winning hand as compared to the dealer's hand.

It is still a further object of the present invention to provide a multistage wagering card game that provides each player with the option to place a bonus wager independent of all other wagers and also independent of the player's decision to continue play with respect to any player's non-bonus wagers.

It is yet a further object of the present invention to provide a multistage wagering card game that provides players with the ability to achieve a hand value of greater than 21 without disqualification or "busting," and even beat a "non-busted" dealer hand.

BRIEF DESCRIPTION OF THE PREFERRED EMBODIMENTS

In accordance with one embodiment of the present invention, a method of playing a multistage wagering card game is disclosed comprising, in combination, the steps of: providing at least one standard deck of playing cards, each card having a value equal to its standard blackjack value, requiring at least one player to place a first wager in a first wagering area, dealing two cards to each at least one player having placed the first wager in the first wagering area, dealing one card face up to a dealer, dealing one card face down to the dealer, requiring each at least one player having placed the first wager in the first wagering area to one of forfeit the first wager and place a second wager of an amount equal to the first wager in a second wagering area, collecting each first wager from any player having forfeited the first wager, revealing the face down dealer card, collecting the first wager from the first wagering area and the second wager from the second wagering area from any remaining player having a two-card value of between 18 and 22 when the dealer having a two-card value closer to a value of 21 than the player, paying an amount at least equal to both the first wager and the second wager to any remaining player having a two-card value of between 18 and 22 and closer to a value of 21 than the dealer having a two-card value between 18 and 22, moving the first wager of any remaining player from the first wagering area to a transitional area when the remaining player having a two-card value further from 21 than a two-card value of the dealer while at the same time the remaining player having a two-card value of less than 18, one of returning the first wager from one of the first wagering area and the transitional area and collecting the first wager from one of the first wagering area and the transitional area and paying an amount equal to the first wager to any remaining player having a value equidistant to 21 as a value of the dealer, dealing one additional card face up to any remaining player having a two-card value of less than 18, dealing one additional card face up to the dealer when the dealer having a two-card value of less than 18, collecting the first wager from one of the first wagering area and the transitional area and the second wager from the second wagering area from any remaining player having a value further from 21 than a value of the dealer, paying an amount at least equal to the second wager to any remaining player having a value closer to a value of 21 than a value of the dealer, paying an amount at least equal to the first wager to any remaining player having a three-card value closer to a value of 21 than a value of the dealer after the player previously having a two-card value less than 18 and closer to 21 than a two-card value of the dealer, returning the first wager from the first wagering area to any remaining player having a value equidistant to 21 as the dealer and previously having a two-card value less than 18 and closer to 21 than a two-card value of the dealer, returning the first wager from the transitional area to any remaining player having a three-card value closer to a value of 21 than a value of the dealer, and one of returning the second wager from the second wagering area to any remaining player having a value equidistant to 21 as a value of the dealer and collecting the second wager from the second wagering area from any remaining player having a value further from 21 as a value of the dealer.

In accordance with another embodiment of the present invention, a method of playing multistage wagering card game is disclosed, comprising, in combination, the steps of: providing at least one standard deck of playing cards, each card having a value equal to its standard blackjack value, requiring at least one player to place a first wager in a first wagering area, the first wagering area being personal to each at least one player, permitting each at least one player to place a bonus wager in a bonus wagering area, the bonus wagering area being personal to each at least one player, dealing two cards to each at least one player having placed one of the first wager and the bonus wager and both the first wager and the bonus wager, dealing one card face up to a dealer, dealing one card face down to the dealer, requiring each at least one player having placed the first wager in the first wagering area to one of forfeit the first wager and place a second wager of an amount equal to the first wager in a second wagering area, the second wagering being personal to each at least one player, collecting each first wager from any player having forfeited the first wager, revealing the face down dealer card, collecting the first wager from the first wagering area and the second wager from the second wagering area from any remaining player having a two-card value of between 18 and 22 when the dealer having a two-card value closer to a value of 21 than the player, collecting the bonus wager from the bonus wagering area from any remaining player having a two card value of one of 18 and 19 and 20 and 22, paying an amount at least equal to both the first wager and the second wager to any remaining player having a two-card value of between 18 and 22 and closer to a value of 21 than the dealer having a two-card value between 18 and 22, moving the first wager of any remaining player from the first wagering area to a transitional area when the remaining player having a two-card value further from 21 than a two-card value of the dealer while at the same time the remaining player having a two-card value of less than 18, one of returning the first wager from one of the first wagering area and the transitional area and collecting the first wager from one of the first wagering area and the transitional area and paying an amount equal to the first wager to any remaining player having a value equidistant to 21 as a value of the dealer, dealing one additional card face up to any remaining player having a two-card value of less than 18, dealing one additional card face up to the dealer when the dealer having a two-card value of less than 18, collecting the first wager from one of the first wagering area and the transitional area and the second wager from the second wagering area from any remaining player having a value further from 21 than a value of the dealer, paying an amount at least equal to the second wager to any remaining player having a value closer to a value of 21 than a value of the dealer, paying an amount at least equal to the first wager to any remaining player having a three-card value closer to a value of 21 than a value of the dealer after the player previously having a two-card value less than 18 and closer to 21 than a two-card value of the dealer, returning the first wager from the first wagering area to any remaining player having a value equidistant to 21 as the dealer and previously having a two-card value less than 18 and closer to 21 than a two-card value of the dealer, returning the first wager from the transitional area to any remaining player having a three-card value closer to a value of 21 than a value of the dealer, one of returning the second wager from the second wagering area to any remaining player having a value equidistant to 21 as a value of the dealer and collecting the second wager from the second wagering area from any remaining player having a value further from 21 as a value of the dealer, paying an amount equal to 1.5 times the first wager and the second wager to any player having a two-card value of 21 when the dealer having a value of one of greater than and less than 21, paying an amount equal to 2 times the second wager to any player having a three-card value of 21 when the dealer having a value of one of greater than and less than 21, paying an amount equal to 2 times the first wager to any player having a three-card value of 21 when the dealer having a value of one of greater than and less than 21 and the dealer previously having a two-card value less than the player's previous two-card value, paying each the at least one player 4 times any placed bonus wager when the at least one player having a two-card value of 21, paying each the at least one player 6 times any placed bonus wager when the at least one player having a three-card value of 21 that also includes at least one card having a value of ten, paying each the at least one player 20 times any placed bonus wager when the at least one player having a three-card value of 21 that does not include a single card having a value of ten, paying each the at least one player 77 times any placed bonus wager when the at least one player having a three-card value of 21 comprising three cards each having a value of 7, and collecting the bonus wager from each the at least one player having placed the bonus wager and achieved a total combined card value of other than 21.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

Common reference numerals are used throughout the drawings and detailed descriptions to indicate like elements.

DETAILED DESCRIPTION OF THE PREFERRED EMBODIMENTS

The present invention includes a method of playing a multistage wagering card game. In the preferred embodiment the dealer is a casino dealer that represents the house or casino, however, it should be clearly understood that substantial benefit could be derived from an alternative embodiment of the present invention in which the dealer is not a casino dealer.

Figure 1:
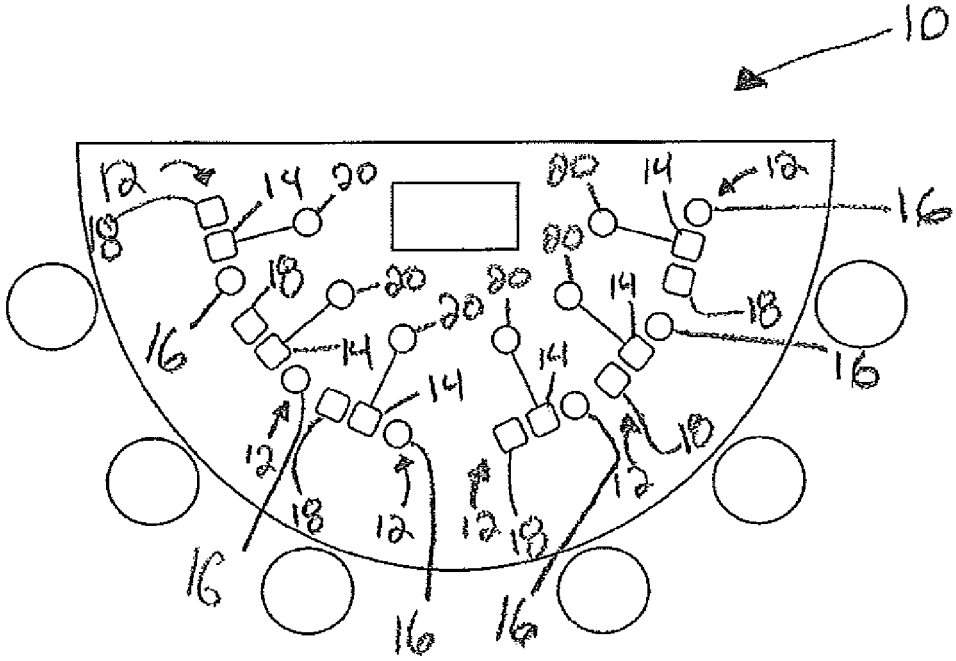
FIG. 1 is a top view of the playing area to be used in conjunction with the live version embodiment of the multistage wagering card game of the present invention, the playing area shows for each player three separate areas for potential placement of various wagers and one transitional area for placement of a first wager following its potential removal from the first wagering area.
Figure 2:
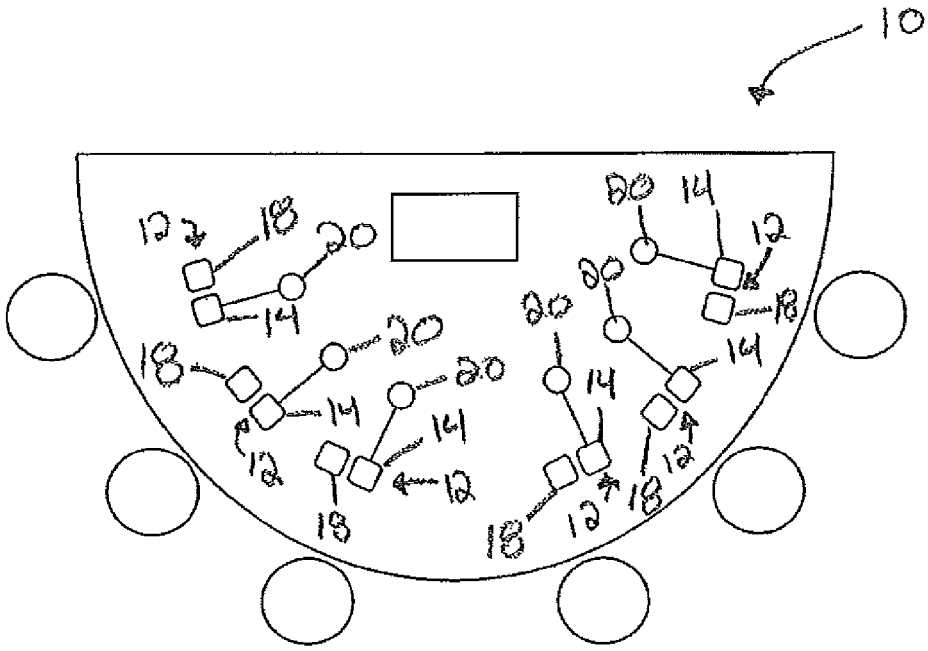
FIG. 2 is a top view of the playing area to be used in conjunction with an alternative embodiment of the multistage wagering card game of the present invention, the playing area shows for each player two separate areas for potential placement of various wagers and one transitional area for placement of an first wager following its potential removal from its first wagering area.
Figure 3:
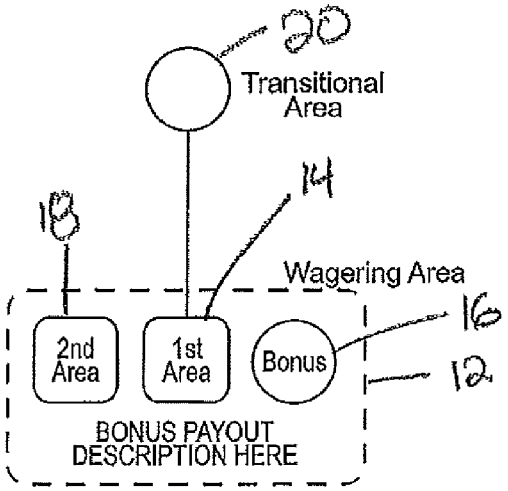
FIG. 3 is a top view of the betting area shown in FIG. 1.
Figure 4:
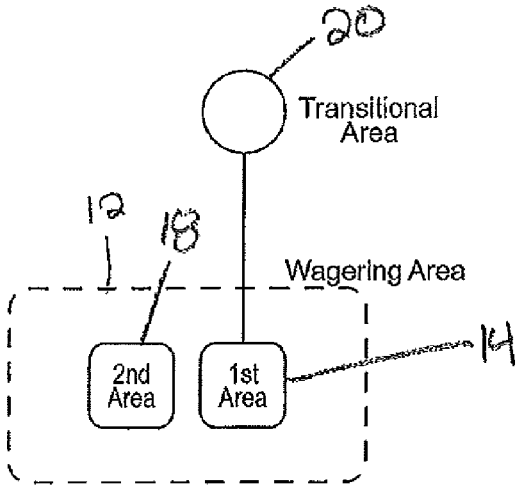
FIG. 4 is a top view of the betting area shown in FIG. 2.
Figure 5:
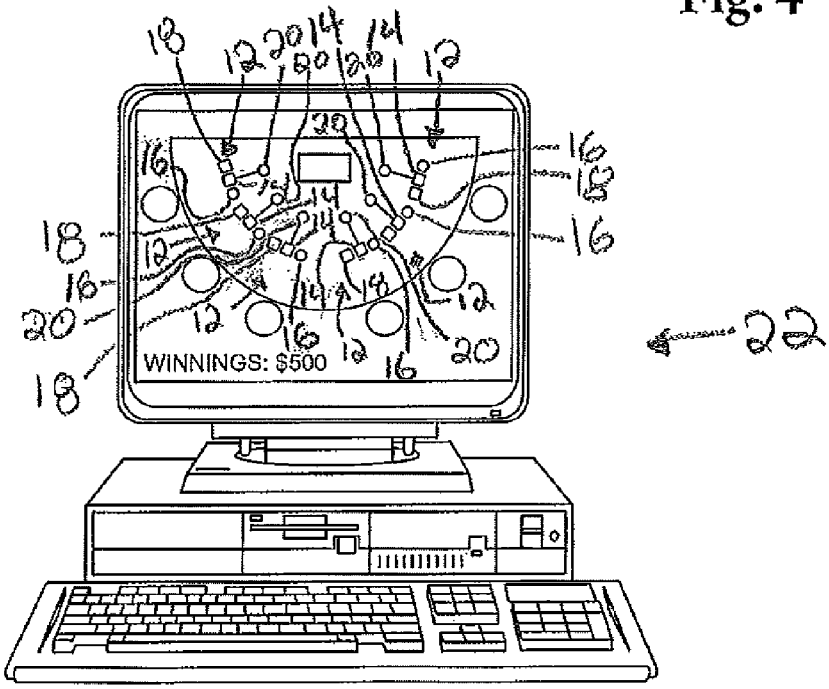
FIG. 5 is a front view of a screen shot of the multistage wagering card game of the present invention in its video-format embodiment.

Referring now to FIGS. 1 and 2, the multistage wagering card game of the present invention is preferably played on a semicircular table top 10, similar in size and dimension to a standard blackjack casino table, although it should be clearly understood that substantial benefit could be derived from an alternative embodiment of the present invention in which the multistage wagering card game of the present invention is played at a different table or on a video screen.

Referring to FIGS. 1-5, each player preferably has his/her own wagering area 12 (if played on a video screen such area may be represented graphically or not exist at all). The first step in the method for playing a multistage wagering card game of the present invention is to provide at least one standard deck of playing cards. Each card in the at least one standard deck has a value equal to its standard blackjack value. The next step is to request each player at the table to place a first wager in a first wagering area 14, at which time the dealer will deal two cards face up to each player and two cards to the dealer, one face down and one face up. In one embodiment of the invention, the players are given the option of placing a bonus wager in a bonus wagering area 16 (shown in FIGS. 1, 3, and 5) in addition to their first wager at the beginning of play, although it should be clearly understood that substantial benefit could be derived from an alternative embodiment of the present invention in which there is no bonus wager option. After all wagers are placed, the dealer gives all players involved in the hand the choice to either forfeit their first wager and fold their hand, or to place a second wager of equal value in a second wagering area 18, a decision assumedly based upon the player comparing their cards to the dealer's single exposed card. The decision to forfeit the first wager preferably has no effect on the bonus wager, if placed, and the player's hand will remain on the table for purposes of determining whether the player's hand qualifies for a bonus payout. If no such bonus wager is placed, then the folded player's cards will preferably be collected by the dealer along with the first wager.

Following this second round of wagering, the next step in the method of playing a multistage wagering card game is the dealer exposing his/her unexposed card. The dealer then compares the dealer's hand to each remaining player's hand. If the dealer's two-card hand is 18 or greater and closer to 21 than a player's two-card hand that is 18 or greater (whether above or below), then the dealer collects all of the player's wagers. It should be noted that in the preferred embodiment two Aces are considered to have a value of 22, although substantial benefit could be derived from an alternative embodiment of the present invention in which two Aces have a value of 12. If the dealer's two-card hand is 18 or greater and further from 21 than a player's two-card hand that is 18 or greater (whether above or below), then any amount remaining in the player's first wagering area 14 and second wagering area 18 is preferably paid even money and returned to the player. In the preferred embodiment, if the player's two-card hand has a value of 21, then any amount remaining in the player's first wagering area 14 and second wagering area 18 is preferably paid 1.5 times their value and returned to the player, although substantial benefit could be derived from an alternative embodiment of the present invention in which a player having a two-card value of 21 is paid even money or an amount greater than 1.5 times the amount wagered. If the dealer's two-card hand is closer to 21 than a player's two-card hand that is less than 18, the player's first wager is moved to a transitional area 20. If the dealer's two-card hand is further from 21 than a player's two-card hand with at least one of the dealer's hand and the player's hand being less than 18, then the player's first wager is left in the first wagering area 14. In the preferred embodiment, if the dealer's two-card hand is the same distance from 21 as the player's two-card hand and both hands have a value that is 18 or greater then this is considered a push and both the first wager and the second wager are returned to the player, although it should be clearly understood that substantial benefit could be derived from an alternative embodiment of the present invention in which a two-card tie where both the dealer hand and the player hand have a value of 18 or greater results in a return of only one of the first wager and the second wager or neither the first wager or the second wager is returned to the player. Alternatively, the dealer could pay a player an amount equal to the first wager, the second wager or both when the player and the dealer have hands with a value equidistant from 21.

The dealer then examines all cards on the table, including his own, to determine which two-card hands have a value of less than 18, and deals one additional card face up to those hands. At this point, the dealer again compares his or her hand to each remaining player's hand. If the dealer's hand is closer to 21, whether above or below, than a player's hand, then the player's remaining first wager and second wager are collected by the dealer from whatever wagering area in which they lie (e.g., first wagering area 14, second wagering area 18 and transitional wagering area 20). If the dealer's hand is further from 21 than a player's hand, then any amount remaining in the player's first wagering area 14 and second wagering area 18 is preferably paid even money and returned to the player. If any amount is within the player's transitional area 20, then that amount is preferably returned to the player and removed from play. If the dealer's hand is the same distance from 21 as the player's hand, any amount remaining in the player's first wagering area 14 and secondary wagering area 18 is preferably returned to the player and any amount within the player's transitional area 20 is preferably collected by the dealer, although as discussed above substantial benefit could be derived from an alternative embodiment of the present invention in which a player hand being equidistant from 21 as a dealer hand is paid as if the player has a winning hand, or the player could lose his or her wager as if the player has a losing hand, or both the first wager and the second wager could be returned to the player.

In the embodiment of the invention involving a bonus wager, the dealer then examines the hand of each player who has placed a wager in the bonus wagering area 16, preferably whether or not the player's first wager was forfeited, to determine whether the player's final hand is equal to a value of 21. If the hand of a player placing a bonus wager is equal to a value of 21, the bonus wager will be paid according to a predetermined payout schedule, otherwise the player's bonus wager and cards are collected by the dealer. In a further embodiment of the invention, each player having placed a bonus wager and having a hand with a value of 21 is preferably paid on his bonus wager in the following manner: any two-card 21 hand is paid 4 to 1; any three-card 21 hand having no card with a value of 10 is paid 20 to 1; any three-card 21 hand consisting solely of 7s is paid 77 to 1; and any remaining there-card 21 hand is paid 6 to 1.

After all wagers are either paid or collected, the dealer then collects all cards remaining on the table 10 and a new hand may begin.

While the invention has been particularly shown and described with reference to preferred embodiments thereof, it will be understood by those skilled in the art that the foregoing and other changes in form and details may be made therein without departing from the spirit and scope of the invention. For example, and referring now to FIG. 5, while the multistage wagering card game of the present invention is preferably played live at a table 10 it should be clear that substantial benefit could be derived from an alternative embodiment of the present invention in which the multistage wagering card game of the present invention is played on a video gaming device, such as a video slot machine or a computer 22 (shown in FIG. 5).

What is claimed is:

1. A method of playing a multistage wagering card game comprising, in combination, the steps of:

providing at least one standard deck of playing cards, each card having a value equal to its standard blackjack value;

requiring at least one player to place a first wager in a first wagering area;

dealing two cards to each said at least one player having placed said first wager in said first wagering area;

dealing one card face up to a dealer;

dealing one card face down to said dealer;

requiring each said at least one player having placed said first wager in said first wagering area to one of forfeit said first wager and place a second wager of an amount equal to said first wager in a second wagering area;

collecting each said first wager from any player having forfeited said first wager;

revealing said face down dealer card;

collecting said first wager from said first wagering area and said second wager from said second wagering area from any remaining player having a two-card value of between 18 and 22 when said dealer having a two-card value closer to a value of 21 than said player;

paying an amount at least equal to both said first wager and said second wager to any remaining player having a two-card value of between 18 and 22 and closer to a value of 21 than said dealer having a two-card value between 18 and 22;

moving said first wager of any remaining player from said first wagering area to a transitional area when said remaining player having a two-card value further from 21 than a two-card value of said dealer while at the same time said remaining player having a two-card value of less than 18;

returning said first wager from said first wagering area to any remaining player having a value equidistant to 21 as a value of said dealer;

dealing one additional card face up to any remaining player having a two-card value of less than 18;

dealing one additional card face up to said dealer when said dealer having a two-card value of less than 18;

collecting said first wager from one of said first wagering area and said transitional area and said second wager from said second wagering area from any remaining player having a value further from 21 than a value of said dealer;

paying an amount at least equal to said second wager to any remaining player having a value closer to a value of 21 than a value of said dealer;

paying an amount at least equal to said first wager to any remaining player having a three-card value closer to a value of 21 than a value of said dealer after said player previously having a two-card value less than 18 and closer to 21 than a two-card value of said dealer;

returning said first wager from said first wagering area to any remaining player having a value equidistant to 21 as said dealer and previously having a two-card value less than 18 and closer to 21 than a two-card value of said dealer;

returning said first wager from said transitional area to any remaining player having a three-card value closer to a value of 21 than a value of said dealer; and one of returning said second wager from said second wagering area to any remaining player having a value equidistant to 21 as a value of said dealer and collecting said second wager from said second wagering area from any remaining player having a value further from 21 as a value of said dealer.

2. The method of claim 1 further comprising the step of paying an amount equal to 1.5 times said first wager and said second wager to any player having a two-card value of 21 when said dealer having a value of one of greater than and less than 21.

3. The method of claim 1 further comprising the steps of:

paying an amount equal to 2 times said second wager to any player having a three-card value of 21 when said dealer having a value of one of greater than and less than 21; and paying an amount equal to 2 times said first wager to any player having a three-card value of 21 when said dealer having a value of one of greater than and less than 21 and said dealer previously having a two-card value less than said player's previous two-card value.

4. The method of claim 1 wherein said first wagering area and said second wagering area and said transitional area being personal to each of said at least one player.

5. The method of claim 1 further comprising the steps of:

permitting each said at least one player to place a bonus wager;

paying each said at least one player having both placed said bonus wager and achieved a total combined card value of 21 with an amount equal to a factor of said bonus wager, wherein said factor being subject to a predetermined payout schedule;

collecting said bonus wager from each said at least one player having placed said bonus wager and having achieved a total combined card value of one of greater than and less than 21.

6. The method of claim 5 wherein said predetermined payout schedule being:

paying each said at least one player 4 times any placed bonus wager when said at least one player having a two-card value of 21;

paying each said at least one player 6 times any placed bonus wager when said at least one player having a three-card value of 21 that also includes at least one card having a value of ten;

paying each said at least one player 20 times any placed bonus wager when said at least one player having a three-card value of 21, wherein each of said three cards having a value of at least one of Ace, 2, 3, 4, 5, 6, 7, 8 and 9; and paying each said at least one player 77 times any placed bonus wager when said at least one player having a three-card value of 21 comprising three cards each having a value of 7.

7. The method of claim 1 wherein two Aces having a value of 22.

8. The method of claim 1 further comprising the steps of:

providing a video gaming machine; and displaying said multistage wagering card game on said video gaming machine.

9. A method of playing a multistage wagering card game comprising, in combination, the steps of:

providing at least one standard deck of playing cards, each card having a value equal to its standard blackjack value;

requiring at least one player to place a first wager in a first wagering area, said first wagering area being personal to each said at least one player;

permitting each said at least one player to place a bonus wager in a bonus wagering area, said bonus wagering area being personal to each said at least one player;

dealing two cards to each at least one player having placed one of said first wager and said bonus wager and both said first wager and said bonus wager;

dealing one card face up to a dealer;

dealing one card face down to said dealer;

requiring each said at least one player having placed said first wager in said first wagering area to one of forfeit said first wager and place a second wager of an amount equal to said first wager in a second wagering area, said second wagering being personal to each said at least one player;

collecting each said first wager from any player having forfeited said first wager;

revealing said face down dealer card;

collecting said first wager from said first wagering area and said second wager from said second wagering area from any remaining player having a two-card value of between 18 and 22 when said dealer having a two-card value closer to a value of 21 than said player;

collecting said bonus wager from said bonus wagering area from any remaining player having a two card value of one of 18 and 19 and 20 and 22;

paying an amount at least equal to both said first wager and said second wager to any remaining player having a two-card value of between 18 and 22 and closer to a value of 21 than said dealer having a two-card value between 18 and 22;

moving said first wager of any remaining player from said first wagering area to a transitional area when said remaining player having a two-card value further from 21 than a two-card value of said dealer while at the same time said remaining player having a two-card value of less than 18;

one of returning said first wager from one of said first wagering area and said transitional area and collecting said first wager from one of said first wagering area and said transitional area and paying an amount equal to said first wager to any remaining player having a value equidistant to 21 as a value of said dealer;

dealing one additional card face up to any remaining player having a two-card value of less than 18;

dealing one additional card face up to said dealer when said dealer having a two-card value of less than 18;

collecting said first wager from one of said first wagering area and said transitional area and said second wager from said second wagering area from any remaining player having a value further from 21 than a value of said dealer;

paying an amount at least equal to said second wager to any remaining player having a value closer to a value of 21 than a value of said dealer;

paying an amount at least equal to said first wager to any remaining player having a three-card value closer to a value of 21 than a value of said dealer after said player previously having a two-card value less than 18 and closer to 21 than a two-card value of said dealer;

returning said first wager from said first wagering area to any remaining player having a value equidistant to 21 as said dealer and previously having a two-card value less than 18 and closer to 21 than a two-card value of said dealer;

returning said first wager from said transitional area to any remaining player having a three-card value closer to a value of 21 than a value of said dealer;

one of returning said second wager from said second wagering area to any remaining player having a value equidistant to 21 as a value of said dealer and collecting said second wager from said second wagering area from any remaining player having a value further from 21 as a value of said dealer;

paying an amount equal to 1.5 times said first wager and said second wager to any player having a two-card value of 21 when said dealer having a value of one of greater than and less than 21;

paying an amount equal to 2 times said second wager to any player having a three-card value of 21 when said dealer having a value of one of greater than and less than 21;

paying an amount equal to 2 times said first wager to any player having a three-card value of 21 when said dealer having a value of one of greater than and less than 21 and said dealer previously having a two-card value less than said player's previous two-card value;

paying each said at least one player 4 times any placed bonus wager when said at least one player having a two-card value of 21;

paying each said at least one player 6 times any placed bonus wager when said at least one player having a three-card value of 21 that also includes at least one card having a value of ten;

paying each said at least one player 20 times any placed bonus wager when said at least one player having a three-card value of 21 that does not include a single card having a value of ten;

paying each said at least one player 77 times any placed bonus wager when said at least one player having a three-card value of 21 comprising three cards each having a value of 7; and collecting said bonus wager from each said at least one player having placed said bonus wager and achieved a total combined card value of other than 21.

10. The method of claim 9 further comprising the steps of:

providing a video gaming machine; and displaying said multistage wagering card game on said video gaming machine.

* * * * *